US005564347A

United States Patent [19]

Kuennen et al.

[11] Patent Number: 5,564,347

[45] Date of Patent: Oct. 15, 1996

[54] ASH CLINKER RAMMING APPARATUS

[75] Inventors: Larry E. Kuennen, Cleveland; Ronald G. Madron, Pawnee; Gary M. Crisp, Ponca City, all of Okla.

[73] Assignee: Oklahoma Gas and Electric Company, Oklahoma City, Okla.

[21] Appl. No.: 422,405

[22] Filed: Apr. 14, 1995

[51] Int. Cl.[6] ..... F23J 1/02

[52] U.S. Cl. ..... 110/171; 414/209

[58] Field of Search ..... 110/165 A, 170, 110/171; 414/209

[56] References Cited

U.S. PATENT DOCUMENTS

| | | | |
|---|---|---|---|
| 1,535,649 | 4/1925 | Bronder . | |
| 3,913,755 | 10/1975 | Kambara et al. | 414/209 |
| 4,479,808 | 10/1984 | Campbell | 48/76 |

FOREIGN PATENT DOCUMENTS

| | | | |
|---|---|---|---|
| 4324277 | 1/1995 | Germany | 110/170 |
| 1141270 | 2/1985 | U.S.S.R. | 110/171 |

*Primary Examiner*—Noah P. Kamen
*Attorney, Agent, or Firm*—Dunlap & Codding, P.C.

[57] ABSTRACT

An apparatus mounted to an enclosure housing of a water entrained ash hopper for dislodging ash pluggages across an ash discharge opening in the ash hopper to maintain passage of ash from the ash hopper. The apparatus comprising a plate rotatably and sealingly connected to the enclosure housing, and a cylinder, mounted to the plate. The cylinder mounted to the plate such that a rod assembly extending from the cylinder is angularly disposed through the plate toward the ash discharge opening so as to be selectively extendable through a selected area of the ash discharge opening along an arc-shaped path. The piston movable from a retracted position to an extended position such that the rod extends into the ash discharge opening to dislodge ash pluggages disposed across the ash discharge opening. The rod assembly adapted to convey a stream of high pressure fluid against the ash pluggage.

27 Claims, 6 Drawing Sheets

ASH CLINKER RAMMING APPARATUS

BACKGROUND OF THE INVENTION

1. Field of the Invention

The present invention is generally related to pokers, and more particularly, but not by way of limitation, to an improved ramming apparatus mounted to an enclosure housing of a water entrained ash hopper for dislodging ash pluggages across an ash discharge opening in the ash hopper to maintain passage of ash from the ash hopper.

2. Description of Related Art

Boilers employed in power plants are often heated by burning coal. The by-product of the combustion of coal is ash. A pair of V-shaped hoppers are positioned beneath the boiler to collect the ash, known as bottom ash, as it falls through the boiler. A typical hopper, having a storage capacity of 6500 cubic feet, will be filled with approximately 25,000 gallons of water in order to absorb the impact of falling ash clinkers, slag and other accumulated deposits.

The ash collected in the hopper is passed from the hopper to a conveying system through a hopper discharge opening. The passage of ash from the hopper is regulated by a hopper door selectively movable back and forth across the hopper discharge opening. An enclosure housing is connected to the hopper to serve as a conduit between the hopper and the conveying system.

The discharge opening of the hopper occasionally becomes plugged or blocked by an accumulation or bridging of ash clinkers and slag thereby preventing ash from being passed from the hopper. When this occurs, power plant personnel in the past have manually poked the ash clinkers with a rod disposed through a pokehole provided in the enclosure housing in an attempt to dislodge the pluggage. While this procedure is sometimes successful in breaking up blockages, if the blockage or bridge is located further in the hopper or to the side of the discharge opening, the plant personnel must open the enclosure housing in order to gain access to the blockage. The problem with this is that when the plant personnel poke at the blockage and in turn break it up with the enclosure housing open, they are exposed to an onrush of 25,000 gallons of hot ash water from which they must take evasive action to avoid serious injury.

To this end, a need has long existed for an adjustable apparatus mountable to the enclosure housing of a water entrained ash hopper for dislodging ash pluggages across the ash discharge opening in the ash hopper while at the same time isolating plant personnel from the hot ash water. It is to such an apparatus that the present invention is directed.

DETAILED DESCRIPTION

Figure 1:
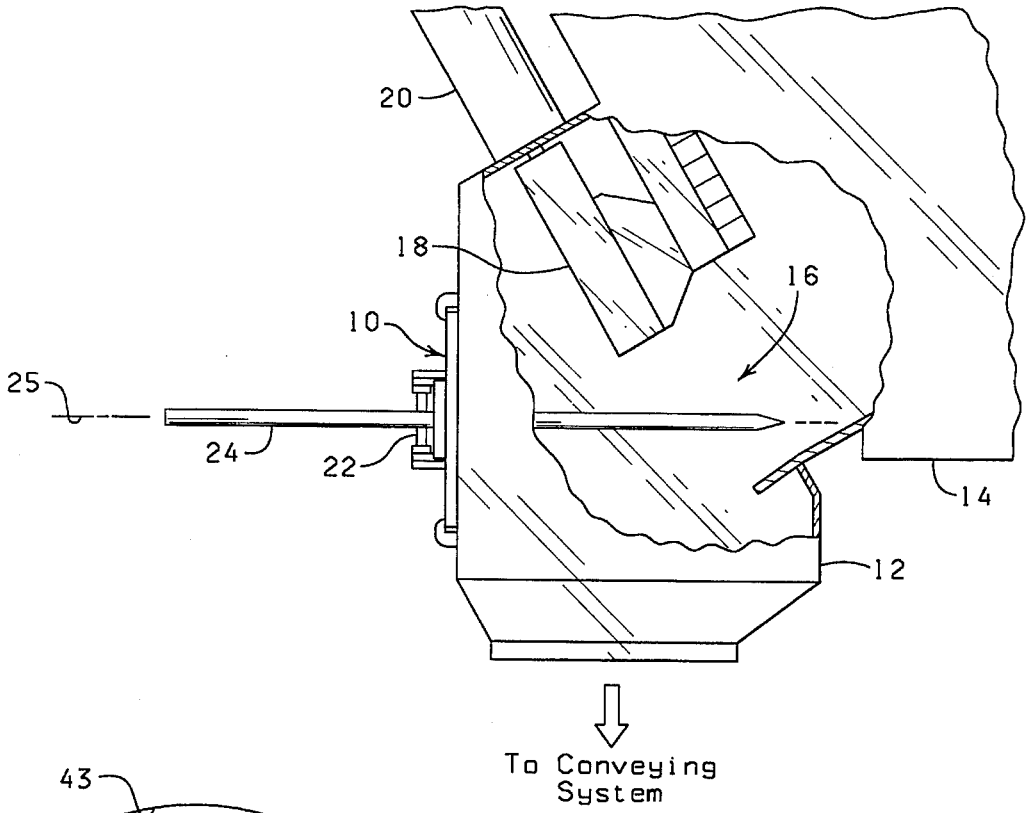
PRIOR ART FIG. 1
FIG. 1 is a partially cut away, elevational view of a portion of a water entrained ash hopper showing a rod extended through a prior art pokehole.

Referring now to the drawings, and more particularly to FIG. 1, a typical enclosure door assembly 10 is shown hingedly connected to an enclosure housing 12. The enclosure housing 12 is bolted to a lower portion of a water entrained hopper 14 which is situated beneath a coal-heated boiler (not shown). The hopper 14 functions to collect bottom ash which is produced by the combustion of coal in the boiler. To this end, the hopper 14 is filled with approximately 25,000 gallons of water to absorb the impact of the falling ash. The collected ash, including ash clinkers, slag and other accumulated deposits, are passed from the hopper 14 to a grinder (not shown) before being placed on a conveyor system (also not shown).

The ash passes from the hopper 14 through a discharge opening 16 provided in the lower portion of the hopper 14. The flow of ash from the hopper 14 is regulated by a hopper door 18 movable back and forth across the hopper discharge opening 16 via a hopper door cylinder 20. The enclosure housing 12 is connected to the hopper 14 to serve as a conduit between the hopper 14 and the grinder.

As previously mentioned, the discharge opening 16 of the hopper 14 occasionally becomes plugged or blocked by an accumulation of larger ash clinkers and slag across the discharge opening 16 which prevent ash from passing from the hopper 14. To permit the blockage to be dislodged, the enclosure door assembly 10 is provided with a pressurized pokehole 22 mounted on a pair of hinges (not shown). The pokehole 22 is adapted to slidably receive a poker 24 which is pushed manually through the discharge opening 16 in an attempt to break up the pluggage. The problem encountered is that the pokehole 22 is constructed in a manner that only allows for the poker 24 to be reciprocally moved along a center line 25 of the pokehole 22 and thus projected through the discharge opening 16 at only one point. That is, the projection of the poker 24 cannot be substantially varied. Therefore, the pluggage often is not broken up because the poker 24 does not come into contact with the source of the pluggage. This can occur when the source of the pluggage is on the side of the discharge opening 16 or deeper in the hopper 14.

When the pluggage cannot be dislodged through the pokehole 22, plant personnel are forced to open the enclosure door assembly 10 in order to reach the pluggage. This is undesirable in that upon the break up of the pluggage, plant personnel are exposed to an onrush of 25,000 gallons of hot ash water.

Because of the inefficiencies and hazards encountered when employing the enclosure door assembly 10 and the manual poker 24 of the prior art to dislodge pluggages across the discharge opening 16 of the hopper 14, a need for an improved apparatus for dislodging pluggages in a water entrained hopper has long been recognized. However, such improved apparatus must be sealingly mounted to the enclosure housing so as to isolate plant personnel from the ash water. Further, the apparatus must have a ram with an adjustable projection, and the construction of the apparatus should be such to provide supplemental or alternate mechanism for breaking up ash pluggages.

Figure 4:
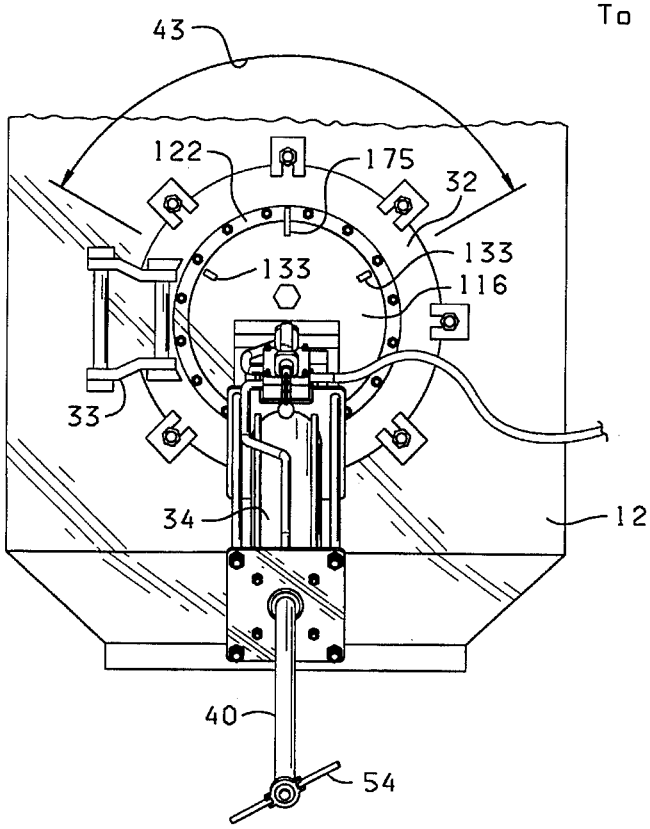
FIG. 4 is an end view of a portion of the ash hopper illustrating the ramming apparatus in a retracted position.
Figure 2:
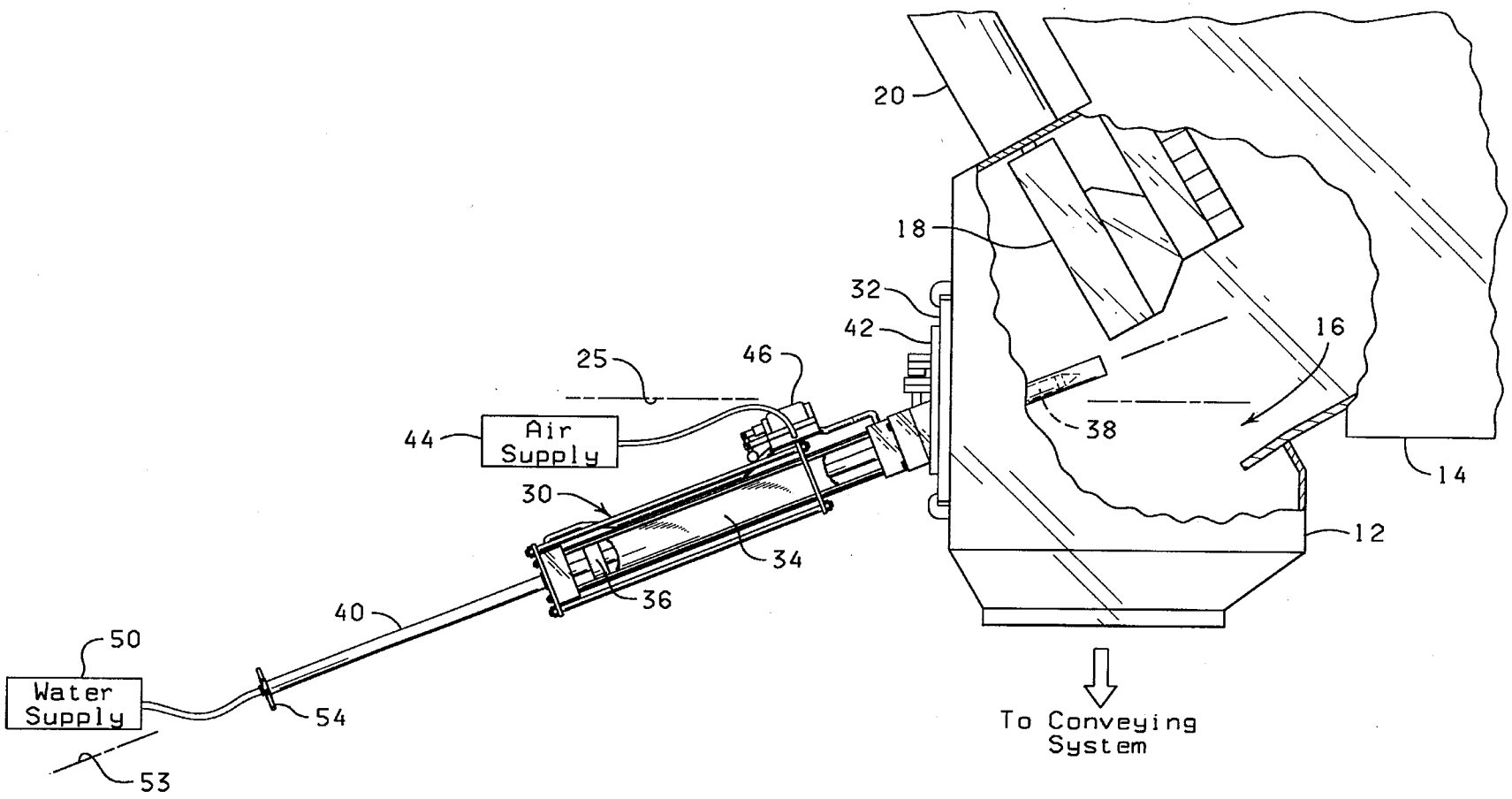
FIG. 2 is a partially cut away, elevational view of a portion of the water entrained ash hopper with a ramming apparatus for dislodging ash pluggages, constructed in accordance with the present invention, mounted to the enclosure housing of a water entrained ash hopper and illustrated in a retracted position.

Referring now to FIG. 2, a ramming apparatus 30 constructed in accordance with the present invention is shown mounted to a modified enclosure door 32 adapted to receive and support the ramming apparatus 30. The enclosure door 32 is hingedly connected to the enclosure housing 12 with a hinge 33 (FIG. 4).

The enclosure door 32 is modified relative to the enclosure door assembly 10 (FIG. 1) by removing the prior art pokehole 22 and replacing it with the ramming apparatus 30 in a manner described in further detail hereinbelow.

The ramming apparatus 30 includes a cylinder 34 having a piston 36 slidably and rotatably disposed therein, a first rod assembly 38 extending from one side of the piston 36 and a second rod assembly 40 extending from the opposite side of the piston 36, and a cylinder mounting assembly 42. The cylinder 34 is positionable in a retracted position (FIG. 2) wherein the first rod assembly 38 is positioned so as not to interfere with the operation of the hopper door 18, and an extended position (FIG. 3) wherein the distal end of the first rod assembly 38 is extended into the discharge opening 16 so as to strike the pluggage therein with a force sufficient to fragment the ash clinkers or deposits creating the pluggage.

The cylinder mounting assembly 42 is adapted to connect the cylinder 34 to the enclosure housing 12 such that the first rod assembly 38 is angularly disposed toward the ash discharge opening 16 so as to be selectively extendable through a selected area of the ash discharge opening 16 along an arc-shaped path. More specifically, the first rod assembly 38 is angularly disposed through the enclosure door 32 so that the first rod assembly 38 is extendable into the discharge opening 16 above the center line 25 of the original pokehole 22. The cylinder 34 is rotatable as represented by arrow 43 in FIG. 4, so as to allow an operator to aim the first rod assembly 38 toward a selected area of the discharge opening 16. However, it should be noted that because of the distance the first rod assembly 38 is extended into the discharge opening 16 and the layout of the enclosure door 32 and the discharge opening 16, the rotation of the cylinder 34 may be required to be limited so that the first rod assembly 38 is not rotated into a position which enables the first rod assembly 38 to be projected against the enclosure housing 12 or the hopper 14.

Fluid pressure is applied to the piston 36 by a compressed air supply 44 connected to the cylinder 34 so as to be in communication with both sides of the piston 36. A control valve 46 is interposed between the air supply 44 and the cylinder 34 in a conventional manner to control the direction of the air flow between each side of the piston 36.

To assist in the dislodgement of ash pluggages across the discharge opening 16, the first and second rod assemblies 38, 40 and the piston 36 are each provided with a fluid flow bore extending longitudinally therethrough so as to provide fluid communication between the distal end of the first rod assembly 38 and the distal end of the second rod assembly 40. A pressurized fluid supply 50 is fluidically connected to the distal end of the second rod assembly 40 such that pressurized fluid can be selectively sprayed from the distal end of the first rod assembly 38 to dislodge ash pluggages disposed across the ash discharge opening 16. The fluid is sprayed from the distal end of the first rod assembly 38 through a nozzle 52 in the distal end of the first rod assembly 38.

To allow the direction of the spray to be varied, the nozzle 52 is angularly offset with respect to the fluid flow bore. Additionally, the first rod assembly 38, the second rod assembly 40, and the piston 36 are rotatable about a longitudinal axis 53 such that the nozzle 52 is in turn selectively rotatable about the longitudinal axis 53. The first rod assembly 38, the second rod assembly 40 and the piston 36 are rotated with a handle assembly 54 clamped to a portion of the second rod assembly 40.

Figures 5, 6:
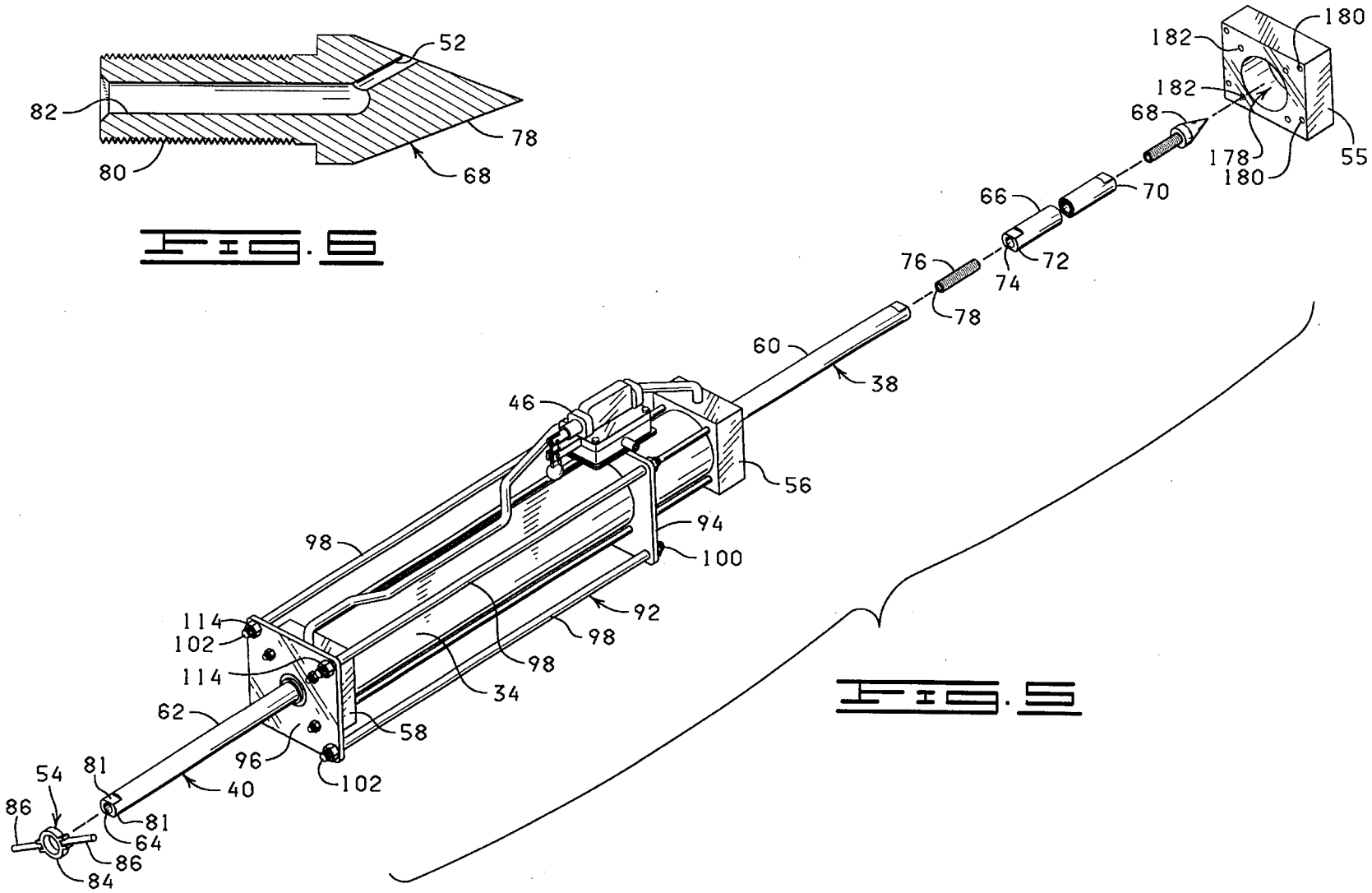
FIG. 5 is an exploded view of a cylinder, a first rod assembly and a second rod assembly.
FIG. 6 is a cross-sectional view of a rod tip.

Referring now to FIGS. 5–8, the components of the ramming apparatus 30 will be described in greater detail. FIG. 5 shows an exploded view of the cylinder 34, the first rod assembly 38, the second rod assembly 40, and an adapter plate 55. The cylinder 34 is a double-end rod cylinder characterized as having a first end 56 and a second end 58. A first piston rod 60, connected to the piston 36 (FIGS. 2 and 3), extends from the first end 56 of the cylinder 34, and a second piston rod 62, connected to the piston 36 (FIGS. 2 and 3), extends from the second end 58 of the cylinder 34. The first piston rod 60, the piston 36, and the second piston rod 62 are provided with a fluid flow bore 64 longitudinally extending therethrough so as to provide fluid communication between the distal end of the first piston rod 60 and the distal end of the second piston rod 62.

The cylinder 34 is preferably a double-end rod pneumatic cylinder with a stroke length of approximately 42 inches. While it will be appreciated that the size of the cylinder 34 can be varied, it is important that the cylinder 34 be of sufficient size to produce a force of approximately 2,800 psi in order to effectively break up most ash clinker pluggages and have a stroke length suitable to extend a sufficient distance into the hopper 14 in the extended position while at the same time not interfering with the operation of the hopper door 18 in the retracted position.

The first rod assembly 38 includes the first piston rod 60, an extension rod 66, and a rod tip 68. The extension rod 66 has a first end 70, a second end 72, and a fluid flow bore 74 extending between the first end 70 and the second end 72 thereof. The extension rod 66 serves to provide the first rod assembly 38 with a length which permits the rod tip 68 of the first rod assembly 38 to be positioned near the hopper door 18 without interfering with the operation of the hopper door 18 when the cylinder 34 is in the retracted position (FIG. 2) thereby enabling the stroke length of the cylinder 34 to be kept at a minimum.

The distal end of the first piston rod 60 and the second end 72 of the extension rod 66 are adapted to be connected with a threaded splice 76. The threaded splice 76 is provided with a bore 78 extending longitudinally therethrough to provide fluid flow between the first piston rod 60 and the extension rod 66.

As best shown in FIG. 6, the rod tip 68 has a tapered head portion 79, a threaded end portion 80, a fluid flow bore 82 and the nozzle 52. The tapered configuration of the head portion 79 facilities breaking up the ash pluggages upon impact of the head portion 79 with ash clinkers and other deposits that make up the pluggage, while the threaded end portion 80 is adapted to threadingly connect the rod tip 68 to the first end 70 of the extension rod 66.

The flow bore 82 of the rod tip 68 extends from the threaded end portion 80 to the nozzle 52 so as to provide fluid communication between the extension rod 66 and the nozzle 52. As mentioned above, the nozzle 52 is angularly offset with respect to the fluid flow bore 82 of the rod tip 68 such that the direction of the spray can be dispersed about the pluggage in a manner to be described in further detail below.

Referring again to FIG. 5, the second rod assembly 40 includes the second piston rod 62. The distal end of the second piston rod 62 is adapted to receive the handle assembly 54 and to be coupled to the pressurized fluid supply 50. To this end, the distal end of the second piston rod 62 is provided with a pair of flattened surfaces 81 and the fluid flow bore 64 is adapted to be coupled to the pressurized fluid supply 50.

The handle assembly 54 includes a bushing 84 and a pair of handle members 86. The bushing 84 is sized to fit over the end of the second piston rod 62. Each of the handle members 86 is pivotally connected to the bushing 84 opposite from one another with a roll pin (not shown) such that the handle members 86 are radially extendable from the bushing 84. The bushing 84 is secured on the end of the second piston rod 62 with a pair of set screws (also not shown). The bushing 84 is positioned on the second piston rod 62 so that the set screws engage the flat surfaces 81 of the second piston rod 62. With the handle assembly 54 connected to the second piston rod 62 and the handle members 86 extended, the first rod assembly 38, the second rod assembly 40, and the piston 36 are easily rotated such that the nozzle 52 is in turn selectively rotatable about the longitudinal axis of the ramming apparatus 30 to selectively aim the spray of fluid from the nozzle 52.

As will be discussed further below, the cylinder 34, along with the first rod assembly 38 and the second rod assembly 40, are removably mounted to the hopper door 18 so as to allow a single cylinder to be used to break up ash pluggages in more than one hopper in that ash pluggages do not continuously exist in a particular hopper, but occur sporadically. As such, it is more cost effective to be able to transport one cylinder 34, along with the first and second rod assemblies 38 and 40, from one hopper to the next as each hopper becomes plugged. To facilitate transporting the cylinder 34 from one hopper to another hopper, a cylinder carrying assembly 92 is attached to the cylinder 34.

The cylinder carrying assembly 92 includes a first end plate 94, a second end plate 96 and a plurality of handle rods 98. The first end plate 94 is adapted to receive the tie rods of the cylinder 34 and is adapted to be disposed about the cylinder 34 near the first end 56 of the cylinder 34. The second end plate 96 is adapted to be connected to the second end 58 of the cylinder 34. The first and second end plates 94, 96 are each adapted to receive the threaded end portions 100, 102 of the handle rods 98. The handle rods 98 are extended between the first end plate 94 and the second end plate 96 and attached thereto in a suitable fashion such as with a plurality of bolts 114 (FIG. 5).

The adapter plate 55 is provided to permit the first end 56 of the cylinder 34 to be connected to the cylinder mounting assembly 42. The adapter plate 55 has a rod receiving opening 178 and two set of bolt holes 180, 182. The bolt holes 182 are spaced apart and sized to be compatible with the first end 56 of the cylinder 34, while the bolt holes 180 are spaced apart and sized to be compatible with the cylinder mounting assembly 42.

Figure 3:
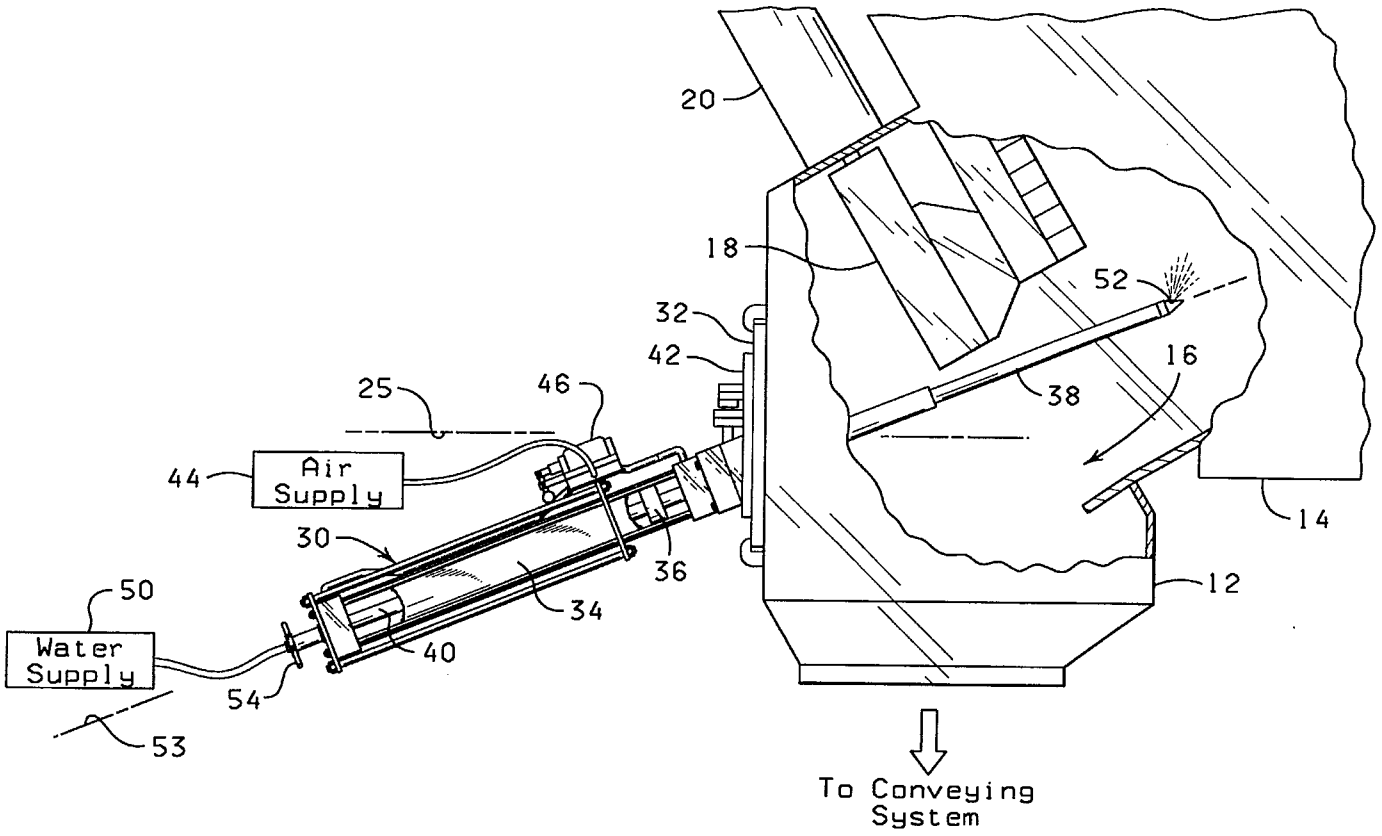
FIG. 3 is a partially cut away, elevational view of a portion of the ash hopper illustrating the ramming apparatus in an extended position.
Figure 7:
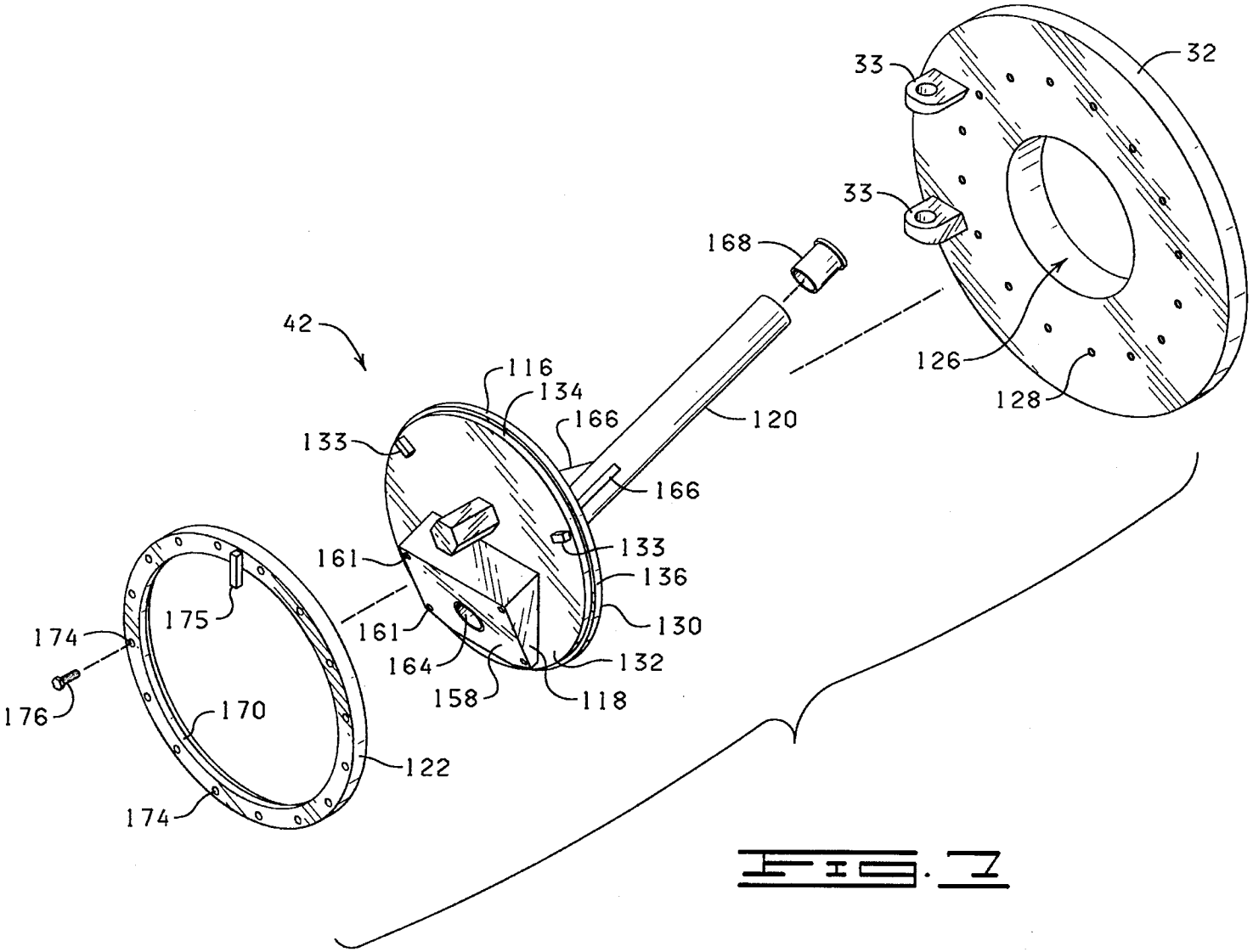
FIG. 7 is an exploded view of a cylinder mounting assembly.
Figure 8:
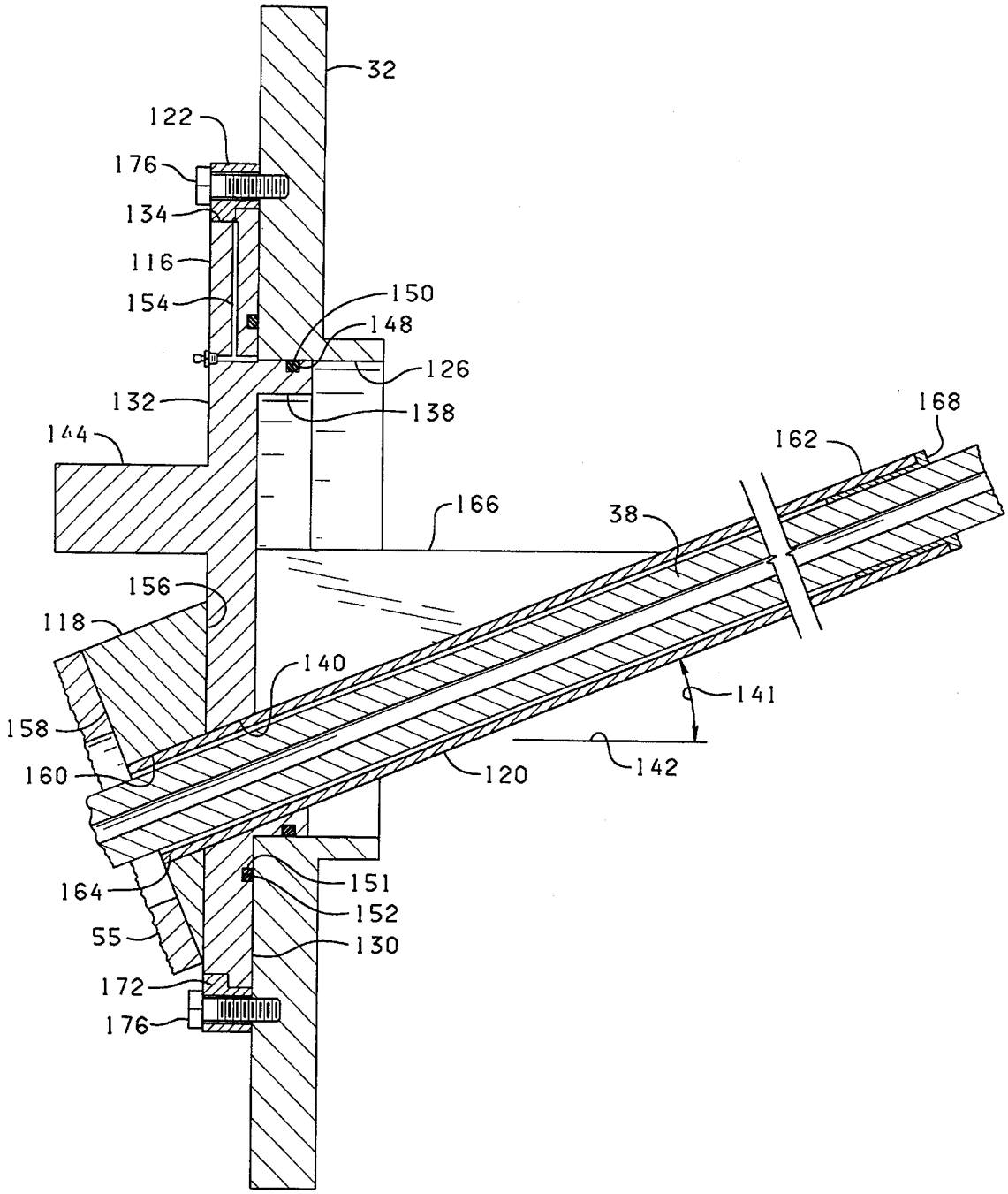
FIG. 8 is a cross-sectional view of the cylinder mounting assembly.

Referring now to FIGS. 3, 7 and 8, the cylinder mounting assembly 42 includes the modified enclosure door 32, a rotational plate 116, a mounting wedge 118, a support tube 120, and a retaining ring 122. The enclosure door 32 is a circular plate having a central door opening 126. The enclosure door 32 is modified relative to the hopper door 18 by removing the pokehole 22 from the enclosure door 32 and providing the enclosure door 32 with a plurality of threaded bores 128 about the door opening 126.

The rotational plate 116 serves as a guide for the first rod assembly 38 through the enclosure door 32 and provides an effective barrier against ash water. The rotational plate 116 is circularly-shaped and has a first side 130, a second side 132, an outer peripheral surface 134 with an outwardly extending lip 136 extending therefrom, a ring portion 138 (FIG. 8), and a rod receiving passageway 140 (FIG. 8) extending angularly therethrough from the first side 130 of the rotational plate 116 to the second side 132 thereof. The rotational plate 116 is further provided with a pair of limit stops 133 on the second side 132 thereof.

The rod receiving passageway 140 is disposed through the rotational plate 116 along an outer portion of the rotational plate 116 such that the rod receiving passageway 140 is off center. The rod receiving passageway 140 is disposed through the rotational plate 116 at an angle 141 of about 22 degrees relative to a line 142 extending perpendicular from the first side 130 of the rotational plate 116 to the second side 132 thereof. The rotational plate 116 is provided with a lug 144 extending from the second side 132 thereof to effect rotation of the rotational plate 116.

The ring portion 138 protrudes perpendicularly from the first side 130 of the rotational plate 116 and is dimensioned to be rotatably disposed within the central door opening 126 of the enclosure door 32 when the rotational plate 116 is connected to the enclosure door 32, as illustrated in FIG. 8. To effect a fluid-tight seal between the ring portion 138 and the enclosure door 32, the ring portion 138 has an outer peripheral surface with an annular groove 148. An 0-ring 150 is positioned within the annular groove 148 in the outer peripheral surface of the ring portion 138 to effect a fluid-tight seal between the rotational plate 116 and the enclosure door 32 when the rotational plate 116 is connected to the enclosure door 32.

To ensure that the enclosure door 32 is sealed, the first side 130 of the rotational plate 116 is also provided with an annular groove 151 with an O-ring 152 being positioned therein to provide a fluid-tight seal between the rotational plate 116 and the enclosure door 32 when the rotational plate 116 is connected to the enclosure door 32.

To facilitate rotation of the rotational plate 116, the rotational plate 116 is provided with a sealable lubricating port 154 extending from the second side 132 thereof to the outer peripheral surface 134 thereof so as to provide fluid communication between the second side 132 of the rotational plate 116 and the outer peripheral surface 134 thereof and allow lubricant to be introduced between the rotational plate 116 and the retaining ring 122 to facilitate rotation of the rotational plate 116. The lubricating port 154 of the rotational plate 116 additionally extends from the second side 132 of the rotational plate 116 to the outer peripheral surface of the ring portion 138 so as to provide fluid communication between the second side 132 of the rotational plate 116 and the outer peripheral surface of the ring portion 138 and allow lubricant to be introduced between the ring portion 138 and the enclosure door 32 to facilitate rotation of the rotational plate 116. Any suitable lubricant may be injected into the lubricating port 154, such as grease.

The mounting wedge 118 provides an angled surface on which to mount the cylinder 34. The mounting wedge 118 has a first side 156, a second side 158, a rod receiving passageway 160 extending therethrough from the first side 156 of the mounting wedge 118 to the second side 158 thereof, and a plurality of threaded bores 161 for securing the cylinder 34 to the mounting wedge 118. The second side 158 of the mounting wedge 118 is set at an angle with respect to the first side 156 thereof. The angle between the first side 156 and the second side 158 is such that the rod receiving passageway 160 of the mounting wedge 118 extends perpendicular through the second side 158 of the mounting wedge 118. Therefore, the rod receiving passageway 160 is angularly disposed relative to the first side 156 so as to be alignable with the rod receiving passageway 140 of the rotational plate 116 when the second side 158 of the mounting wedge 118 is connected to the second side 132 of the rotational plate 116.

As shown in FIG. 8, the second side 158 of the mounting wedge 118 is connected to the second side 132 of the rotational plate 116 with the rod receiving passageway 160 of the mounting wedge 118 aligned with the rod receiving passageway 140 of the rotational plate 116. The mounting wedge 118 is connected to the rotational plate 116 in any suitable fashion, such as by welding.

The support tube 120 is provided to support the first rod assembly 38 when the first rod assembly 38 is extended against ash pluggages across the ash discharge opening 16. The support tube 120 is rigid and sized to slidably receive the first rod assembly 38. The support tube 120 has a first end 162 and a second end 164 and is dimensioned such that the second end 164 of the support tube 120 extends through the rod receiving passageways 140 and 160 of the rotational plate 116 and the mounting wedge 118, as shown in FIG. 8, and the first end 162 extends from the first side 130 of the rotational plate 116 toward the discharge opening 16 of the hopper 14. The support tube 120 is preferably a length which enables the support tube 120 to extend near the hopper door 18 without interfering with the operation of the hopper door 18.

The support tube 120 is reinforced with a pair of gussets 166 (only one shown in FIG. 9) secured between the first side 130 of the rotational plate 116 and the support tube 120.

A brass nose bushing 168 is pressed into the first end 162 of the support tube 120 to guide the first rod assembly 38 and prevent the first rod assembly 38 from deflecting when extended against ash pluggages. The nose bushing 168 additionally acts as a scraper about the first rod assembly 38 to prevent ash and debris from entering the support tube 120 and hindering the movement of the first rod assembly 38 through the support tube 120.

An assembly of the rotational plate 116, the mounting wedge 118 and the support tube 120 is secured to the hopper door 18 with the retaining ring 122. The retaining ring 122 is dimensioned to fit about the outer peripheral surface 134 of the rotational plate 116 and has an inner surface 170 which is configured to be compatible with the outer peripheral surface 134 of the rotational plate 116. More specifically, the retaining ring 122 has an inwardly extending lip 172 positionable over the outwardly extending lip 136 of the rotational plate 116. The retaining ring 122 is provided with a plurality of bolt holes 174 alignable with the threaded bores 128 of the enclosure door 32. The retaining ring 122 is provided with an inwardly extending finger 175 for cooperating with the limit stops 133 of the rotational plate 116 to limit the rotation of the rotational plate 116.

The rotational plate 116 with the mounting wedge 118 and the support tube 120 are mounted to-the enclosure door 32 by disposing the support tube 120 through the central door opening 126 of the enclosure door 32 and fitting the ring portion 138 of the rotational plate 116 into the central door opening 126. The retaining ring 122 is then positioned over the outer peripheral surface 134 of the rotational plate 116 with the inwardly extending finger 175 of the retaining ring 122 positioned between the limit stops 133 of the rotational plate 116, as shown in FIG. 3, such that the angle of rotation of the rotational plate 116 is limited to about 120 degrees. More specifically, the limit stops 133 and the finger 175 are arranged so that the mounting wedge 118 is rotated between four o'clock and eight o'clock such that the first rod assembly 38 is extendable through the discharge opening 16 along an arc-shaped path extending from the upper right-hand quadrant of the discharge opening 16 to the upper left-hand quadrant thereof. This configuration permits the first rod assembly 38 to be extended through the discharge opening 16 into the hopper 14 at a particular point along an arc-shaped path without the possibility of damaging the hopper 14. The retaining ring 122 is secured to the enclosure door 32 with a plurality of studs 176.

OPERATION

The rotational plate 116, along with the mounting wedge 118 and support tube 120, is attached to the enclosure door 32 with the retaining ring 122. When the cylinder 34 is not mounted to the mounting wedge 118, a cover plate (not shown) along with a gasket (also not shown) is bolted to the mounting wedge 118 to seal the rod receiving passageway 160 of the mounting wedge 118.

When the discharge opening becomes plugged with ash clinkers and slag, the hopper door 18 is closed while the enclosure housing 12 is drained. The cover plate (not shown) is removed and the cylinder 34 is bolted to the mounting wedge 118 by securing the adapter plate 55 to the first end 56 of the cylinder 34 and bolting the adapter plate 55 to the second side 158 of the mounting wedge 118. The first end 56 of the cylinder 34 is connected to the second side 158 of the mounting wedge 118 such that the first rod assembly 38 slidably extends through the support tube 120 so as to be angularly disposed toward the ash discharge opening 16.

After mounting the cylinder 34 to the mounting wedge 118, the conveying system (not shown) is started and the hopper door 18 is opened. With the hopper door 18 open, the cylinder 34 is moved to the extended position so that the first rod assembly 38 extends into the ash discharge opening 16 and impacts the ash disposed across the discharge opening 16 (FIG. 3).

In the extended position, a spray of high pressure fluid can be selectively directed against the pluggage to assist in dislodging the pluggage. The nozzle 52 is pointed in a selected direction by rotating the first and second rod assemblies 38, 40 and the piston 36 with the handle assembly 54.

If after impacting the ash with the rod tip 68 and injecting the ash with high pressure fluid, the pluggage is not dislodged, the studs 176 of the retaining ring 122 can be loosened and the rotational plate 116 rotated via the lug 144 to another position. The angularity of the first rod assembly 38 with respect to the rotational plate 116 enables the first rod assembly 38 to be aimed at a selected location along an arc-shaped path across the discharge opening 16.

When rotated to the desired position, the studs 176 are tightened and the cylinder 34 again moved to the extended position. This procedure of rotating the cylinder 34 enables the pluggage to be impacted at several locations in a safe manner. Rotation of the rotational plate 116 can be safely accomplished at any time during the conveying process since personnel are isolated at all times from the ash water.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. An apparatus mounted to an enclosure housing of a water entrained ash hopper for dislodging ash pluggages across an ash discharge opening in the ash hopper to maintain passage of ash from the ash hopper, the apparatus comprising:

a plate rotatably and sealingly connected to the enclosure housing, the plate having a first side, a second side and a rod receiving passageway extending angularly therethrough from the first side of the plate to the second side thereof;

a cylinder having a first end, a second end and a piston having a rod extending therefrom, the piston slidably disposed within the cylinder so that the rod extends from the second end of the cylinder, the first end of the cylinder connected to the second side of the plate such that the rod slidably extends through the rod receiving passageway of the plate and is angularly disposed toward the ash discharge opening so as to be selectively extendable through a selected area of the ash discharge opening; and actuating means for selectively actuating the piston so that the rod is movable from a retracted position to an extended position such that the rod extends into the ash discharge opening to dislodge ash pluggages disposed across the ash discharge opening.

2. The apparatus of claim 1 wherein the rod of the piston is defined as a first rod having a distal end and wherein the piston has a second rod having a distal end extending from the second end of the cylinder, wherein the first rod, the second rod and the piston are each provided with a fluid flow bore extending longitudinally therethrough so as to provide fluid communication between the distal end of the first rod and the distal end of the second rod, and wherein the apparatus further comprises:

a pressurized fluid supply fluidically connected to the distal end of the second rod such that pressurized fluid can be selectively discharged from the distal end of the first rod to dislodge ash pluggages disposed across the ash discharge opening.

3. The apparatus of claim 2 wherein the distal end of the first rod is provided with a nozzle.

4. The apparatus of claim 3 wherein the nozzle is angularly offset with respect to the longitudinal axis of the first rod.

5. The apparatus of claim 4 wherein the first rod, the second rod and the piston are rotatable about the longitudinal axis thereof such that the nozzle is selectively rotatable about the longitudinal axis.

6. The apparatus of claim 1 wherein the first side of the plate is provided with an annular groove, and wherein the plate further comprises:

an O-ring positionable within the annular groove to provide a fluid seal between the plate and the enclosure housing when the plate is connected to the enclosure housing.

7. The apparatus of claim 6 wherein the plate is provided with a lug extending from the second side thereof to effect rotation of the plate.

8. The apparatus of claim 6 wherein the plate is connected to an enclosure door of the enclosure housing, the enclosure door having an opening extending therethrough, and wherein the plate is provided with a ring portion extending from the first side of the plate and dimensioned to be rotatably disposable within the opening of the enclosure door when the plate is connected to the enclosure door.

9. The apparatus of claim 8 wherein the ring portion of the plate has an outer peripheral surface with an annular groove, and wherein the plate further comprises:

an O-ring positionable within the annular groove in the outer peripheral surface of the ring portion to provide a fluid seal between the plate and the enclosure door when the plate is connected to the enclosure door.

10. The apparatus of claim 9 wherein the plate has a sealable lubricating port extending between the second side of the plate and the outer peripheral surface of the ring portion so as to provide fluid communication between the second side of the plate and the outer peripheral surface of the ring portion and allow lubricant to be introduced between the ring portion and the enclosure door to facilitate rotation of the plate.

11. The apparatus of claim 1 wherein the plate is defined as having a horizontal axis extending perpendicular between the first and second sides thereof, and wherein the rod receiving passageway is disposed at an angle of about 22 degrees relative to the horizontal axis of the plate.

12. The apparatus of claim 1 wherein the first end of the cylinder is connected to the second side of the plate via a mounting wedge having a first side, a second side and a rod receiving passageway extending therethrough from the first side of the mounting wedge to the second side thereof, the second side of the mounting wedge angularly disposed relative to the first side of the mounting wedge so that the rod receiving passageway thereof extends substantially perpendicular to the second side and is aligned with the rod receiving passageway of the plate when the first side of the mounting wedge is connected to the second side of the plate and so that the rod of the piston is slidably disposed through the rod receiving passageways of the mounting wedge and the plate when the first end of the cylinder is connected to the second side of the mounting wedge.

13. The apparatus of claim 1 further comprising:

a support tube dimensioned to slidably receive the rod of the piston, the tube extending from the first side of the plate in alignment with the rod receiving passageway of the plate so as to receive the rod and prevent the rod from bending when the rod is extended against ash pluggages across the ash discharge opening.

14. The apparatus of claim 1 further comprising:

a retaining ring having an inner peripheral surface slidingly matable with the outer peripheral surface of the plate, the retaining ring positioned over the outer peripheral surface of the plate and attached to the enclosure housing so as to connect the plate to the enclosure housing.

15. The apparatus of claim 14 wherein the plate has a sealable lubricating port extending between the second side thereof and the outer peripheral surface thereof so as to provide fluid communication between the second side of the plate and the outer peripheral surface thereof and allow lubricant to be introduced between the plate and the retaining ring to facilitate rotation of the plate.

16. An apparatus mounted to an enclosure housing of a water entrained ash hopper for dislodging ash pluggages across an ash discharge opening in the ash hopper to maintain passage of ash from the ash hopper, the apparatus comprising:

a plate having a first side, a second side and a rod receiving passageway extending angularly therethrough from the first side of the plate to the second side thereof;

a mounting wedge having a first side, a second side, and a rod receiving passageway extending therethrough from the first side of the mounting wedge to the second side thereof, the second side of the mounting wedge angularly disposed relative to the first side thereof, the first side of the mounting wedge connected to the second side of the plate such that the second side of the mounting wedge is angularly disposed relative to the first side of the mounting wedge and such that the rod receiving passageway thereof extends substantially perpendicular to the second side of the mounting wedge and is aligned with the rod receiving passageway of the plate when the first side of the mounting wedge is connected to the second side of the plate;

a cylinder having a first end, a second end and a piston having a rod extending therefrom, the piston slidably disposed within the cylinder so that the rod extends from the first end of the cylinder, the first end of the cylinder connected to the second side of the mounting wedge such that the rod slidably extends through the rod receiving passageways of the mounting wedge and the plate and is angularly disposed toward the ash discharge opening so as to be selectively extendable through a selected portion of the ash discharge opening along an arc-shaped path;

a support tube dimensioned to slidably receive the rod of the piston, the support tube extending from the first side of the plate in alignment with the rod receiving passageways of the plate and the mounting wedge so as to receive the rod and prevent the rod from bending when the rod is extended against ash pluggages across the ash discharge opening;

a retaining ring having an inner peripheral surface slidingly matable with the outer peripheral surface of the plate, the retaining ring positioned over the outer peripheral surface of the plate and attached to the enclosure housing so as to rotatably connect the plate to the enclosure housing; and actuating means for selectively actuating the piston so that the rod is movable from a retracted position to an extended position such that the rod extends into the ash discharge opening to dislodge ash pluggages disposed across the ash discharge opening.

17. The apparatus of claim 16 wherein the rod of the piston is defined as a first rod having a distal end and wherein the piston has a second rod having a distal end extending from the second end of the cylinder, wherein the first rod, the second rod and the piston are each provided with a fluid flow bore extending longitudinally therethrough so as to provide fluid communication between the distal end of the first rod and the distal end of the second rod, and wherein the apparatus further comprises:

a pressurized fluid supply fluidically connected to the distal end of the second rod such that pressurized fluid can be selectively discharged from the distal end of the first rod to dislodge ash pluggages disposed across the ash discharge opening.

18. The apparatus of claim 17 wherein the distal end of the first rod is provided with a nozzle.

19. The apparatus of claim 18 wherein the nozzle is angularly offset with respect to the longitudinal axis of the first rod.

20. The apparatus of claim 19 wherein the first rod, the second rod and the piston are rotatable about the longitudinal axis thereof such that the nozzle is selectively rotatable about the longitudinal axis.

21. The apparatus of claim 20 wherein the first side of the plate is provided with an annular groove, and wherein the plate further comprises:

an O-ring positionable within the annular groove to provide a fluid seal between the plate and the enclosure housing when the plate is connected to the enclosure housing.

22. The apparatus of claim 21 wherein the plate has a sealable lubricating port extending between the second side thereof and the outer peripheral surface thereof so as to provide fluid communication between the second side of the plate and the outer peripheral surface thereof and allow lubricant to be introduced between the plate and the retaining ring to facilitate rotation of the plate.

23. The apparatus of claim 22 wherein the plate is provided with a lug extending from the first side thereof to effect rotation of the plate.

24. The apparatus of claim 20 wherein the plate is defined as having a horizontal axis extending perpendicular between the first and second sides thereof, and wherein the rod receiving passageway is disposed at an angle of about 22 degrees relative to the horizontal axis of the plate.

25. The apparatus of claim 16 wherein the plate is connected to an enclosure door of the enclosure housing, the enclosure door having an opening extending therethrough, and wherein the plate is provided with a ring portion extending from the first side of the plate and dimensioned to be rotatably disposable within the opening of the enclosure door when the plate is connected to the enclosure door.

26. The apparatus of claim 25 wherein the ring portion of the plate has an outer peripheral surface with an annular groove, and wherein the plate further comprises:

an O-ring positionable within the annular groove in the outer peripheral surface of the ring portion to provide a fluid seal between the plate and the enclosure door when the plate is connected to the enclosure door.

27. The apparatus of claim 26 wherein the lubricating port of the plate extends between the second side of the plate to the outer peripheral surface of the ring portion so as to provide fluid communication between the second side of the plate and the outer peripheral surface of the ring portion and allow lubricant to be introduced between the ring portion and the enclosure door to facilitate rotation of the plate.

* * * * *